US008770106B2

(12) United States Patent
Muir et al.

(10) Patent No.: US 8,770,106 B2
(45) Date of Patent: Jul. 8, 2014

(54) PRINTER COMPONENT MOUNTING AND ALIGNMENT SYSTEM

(75) Inventors: Christopher M. Muir, Rochester, NY (US); William F. Dassero, Rochester, NY (US); Martin C. James, Rochester, NY (US); Allan M. Waugh, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 441 days.

(21) Appl. No.: 12/712,296

(22) Filed: Feb. 25, 2010

(65) Prior Publication Data

US 2011/0203471 A1 Aug. 25, 2011

(51) Int. Cl.
*B41F 1/08* (2006.01)

(52) U.S. Cl.
USPC ..... 101/288; 101/481; 347/49

(58) Field of Classification Search
USPC ..... 101/481, 288; 29/281.5; 347/49, 104
See application file for complete search history.

(56) References Cited

U.S. PATENT DOCUMENTS

| | | | | |
|---|---|---|---|---|
| 6,003,988 | A | 12/1999 | McCann et al. | |
| 6,015,209 | A | 1/2000 | Barinaga et al. | |
| 6,412,990 | B1 * | 7/2002 | Stoffel et al. | 396/599 |
| 6,516,688 | B2 * | 2/2003 | Albertson | 81/59.1 |
| 6,659,602 | B2 * | 12/2003 | Izawa et al. | 347/102 |
| 6,857,803 | B2 * | 2/2005 | Smith | 400/656 |
| 8,205,984 | B2 * | 6/2012 | Tarnacki et al. | 347/104 |
| 8,226,224 | B2 * | 7/2012 | Hanson et al. | 347/102 |
| 2002/0157555 | A1 * | 10/2002 | Smith | 101/480 |
| 2002/0192001 | A1 * | 12/2002 | McIntyre et al. | 400/583 |
| 2004/0135857 | A1 | 7/2004 | Hashii et al. | |
| 2006/0072001 | A1 * | 4/2006 | Klein | 347/171 |
| 2009/0189929 | A1 * | 7/2009 | Motojima et al. | 347/2 |
| 2009/0295878 | A1 * | 12/2009 | Hanchak et al. | 347/74 |
| 2010/0188468 | A1 * | 7/2010 | Herpel et al. | 347/101 |

FOREIGN PATENT DOCUMENTS

| | | | |
|---|---|---|---|
| EP | 0 729 844 | A1 | 9/1996 |
| EP | 1 447 226 | A1 | 8/2004 |
| WO | WO 2009/145870 | A1 | 12/2009 |

OTHER PUBLICATIONS

U.S. Appl. No. 12/627,032, filed Nov. 30, 2009, entitled "Modular Media Transport System" by DeCook et al.
U.S. Appl. No. 12/627,018, filed Nov. 30, 2009 entitled "Media Transport System for Non-Contacting Printing" by Muir et al.
German Patent Application No. 102009039444.3 filed Aug. 31, 2009 entitled "Adaptive Stitch Method", by Schluenss et al.

* cited by examiner

*Primary Examiner* — Ren Yan
(74) *Attorney, Agent, or Firm* — William R. Zimmerli

(57) ABSTRACT

A printing system includes a frame. A first printer component is mounted to the frame. A second printer component is compliantly mounted to the frame such that the second printer component is free to move in a plane. A first alignment mechanism is kinematically coupled to the first printer component and is kinematically coupled to the second printer component. A second alignment mechanism is kinematically coupled to the first printer component and is kinematically coupled to the second printer component.

20 Claims, 18 Drawing Sheets

PRINTER COMPONENT MOUNTING AND ALIGNMENT SYSTEM

FIELD OF THE INVENTION

The present invention generally relates to apparatus for printing on continuous web media and more particularly relates to a mounting system that provides alignment of printer components.

BACKGROUND OF THE INVENTION

Continuous web printing allows economical, high-speed, high-volume print reproduction. In this type of printing, a continuous web of paper or other substrate material is fed past one or more printing subsystems that form images by applying one or more colorants onto the substrate surface. In a conventional web-fed rotary press, for example, a web substrate is fed through one or more impression cylinders that perform contact printing, transferring ink from an imaging roller onto the web in a continuous manner.

Proper registration of the substrate to the printing device is of considerable importance in print reproduction, particularly where multiple colors are used in four-color printing and similar applications. Conventional web transport systems in today's commercial offset printers address the problem of web registration with high-precision alignment of machine elements. Typical of conventional web handling subsystems are heavy frame structures, precision-designed components, and complex and costly alignment procedures for precisely adjusting substrate transport between components and subsystems.

The problem of maintaining precise and repeatable web registration and transport becomes even more acute with the development of high-resolution non-contact printing, such as high-volume inkjet printing. With this type of printing system, finely controlled dots of ink are rapidly and accurately propelled from the printhead onto the surface of the moving media, with the web substrate often coursing past the printhead at speeds measured in hundreds of feet per minute. No impression roller is used; synchronization and timing are employed to determine the sequencing of colorant application to the moving media. With dot resolution of 600 dots-per-inch (DPI) and better, a high degree of registration accuracy is needed.

One factor for maintaining registration accuracy relates to the mounting and alignment of the printer components that apply the ink or other liquid onto the rapidly moving medium. Temperature effects, for example, can compromise registration as materials having different Coefficients of Thermal Expansion (CTEs) expand or contract at different rates. One temperature concern for inkjet printers relates to the need for drying equipment at one or more positions along the paper path. Heat that is generated for drying the media is concentrated over small portions of the printer system, creating potential localized hot-spots, with changing temperature gradients during printer operation.

With the increased size and complexity of a large-scale, continuous web printing system, conventional solutions for printhead registration and alignment fall far short of what is needed. This problem becomes particularly significant when considering practical concerns such as system assembly procedures, scalability of the system, the need for repair, replacement, or reconfiguration in the field, and variable ambient temperatures and other environmental factors for printing systems. It would be advantageous, for example, to allow system reconfiguration or repair without requiring excessive cost and time for maintaining alignment of printer components along the paper path.

Thus, there is a need for a printing system that provides alignment of printer components relative to each other or to other aspects of the printing system, for example, a moving media web, without the requiring complex or costly alignment and adjustment procedures and without imposing constraints on the environment in which the printing system is used.

SUMMARY OF THE INVENTION

It is an object of the present invention to advance the art of continuous web printing by providing a kinematically coupled alignment apparatus. The present invention addresses alignment problems due to uneven thermal expansion and provides ways to correct and adjust for misalignment of printer components during assembly into a frame and during printing operation.

With these objects in mind, the present invention provides a printing system that includes a frame. A first printer component is mounted to the frame. A second printer component is compliantly mounted to the frame such that the second printer component is free to move in a plane. A first alignment mechanism is kinematically coupled to the first printer component and is kinematically coupled to the second printer component. A second alignment mechanism is kinematically coupled to the first printer component and is kinematically coupled to the second printer component.

Advantageously, embodiments of the present invention use kinematic coupling to prevent over-constraint of mounted printer components. The alignment mechanisms of the present invention allow the use of materials having matched coefficients of thermal expansion, so that movement of printer components resulting from thermal expansion or contraction occurs in a controlled and predictable manner.

BRIEF DESCRIPTION OF THE DRAWINGS

In the detailed description of the example embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art. Figures provided are intended to show principles of operation and relationships between components and are may not be drawn to scale.

In the context of the present disclosure, the term "continuous web of print media" relates to a print media that is in the form of a continuous strip of media as it passes through the printing system from an entrance to an exit thereof. The continuous web of print media itself serves as the receiving print medium to which one or more printing ink or inks or other coating liquids are applied in non-contact fashion. The terms "upstream" and "downstream" are terms of art referring to relative positions along the transport path of a moving web; points on the web move from upstream to downstream. Where they are used, the terms "first", "second", and so on, do not necessarily denote any ordinal or priority relation, but are simply used to more clearly distinguish one element from another.

Figure 1:
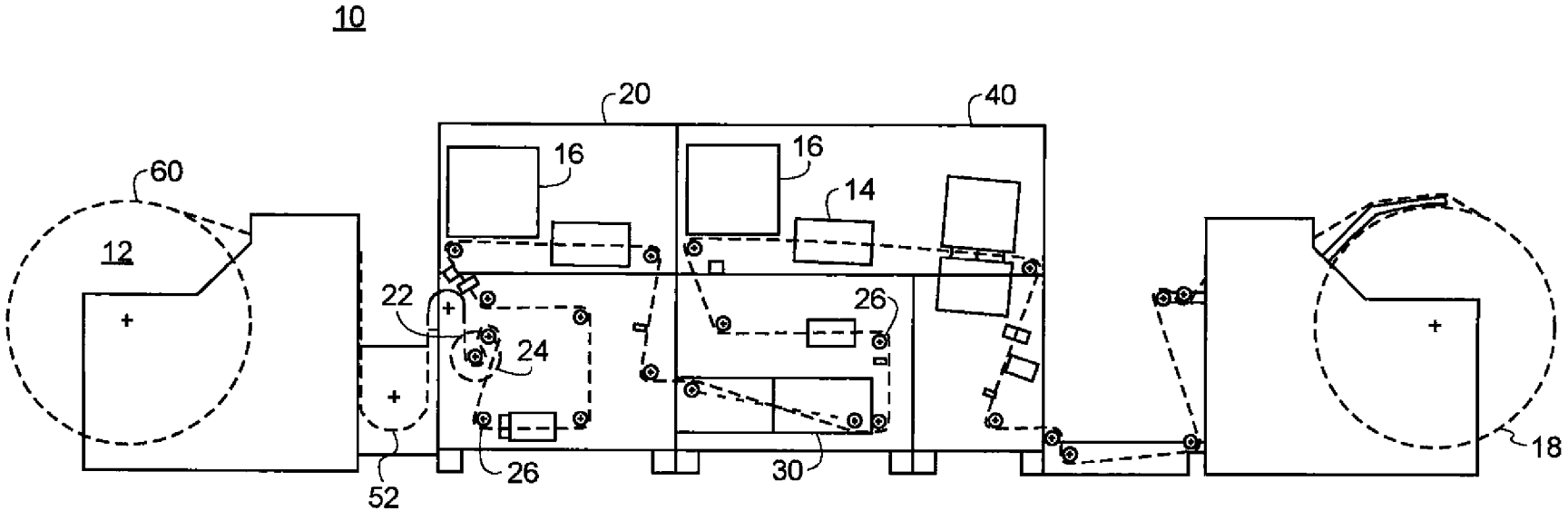
FIG. 1 is a schematic side view of a digital printing system according to an embodiment of the present invention.

Referring to the schematic side view of FIG. 1, there is shown a digital printing system 10 for continuous web printing according to one embodiment. A first module 20 and a second module 40 are provided for guiding continuous web media 60 that originates from a source roller 12. Following an initial slack loop 52, the media that is fed from source roller 12 is then directed through digital printing system 10, past one or more digital printhead assemblies 16 and other printing system 10 components, for example, a dryer 14. As shown in FIG. 1, first module 20 includes a cross-track positioning mechanism 22, a tensioning mechanism 24, and one or more angular constraint structures 26. Second module 40 includes a media turnover mechanism 30 and one or more additional angular constraint structures 26. After the print media leaves the digital printing system 10, it travels to a media receiving unit, in this case a take-up roll 18. Other examples of system components include web cleaners, web tension sensors, and quality control sensors.

Figure 2:
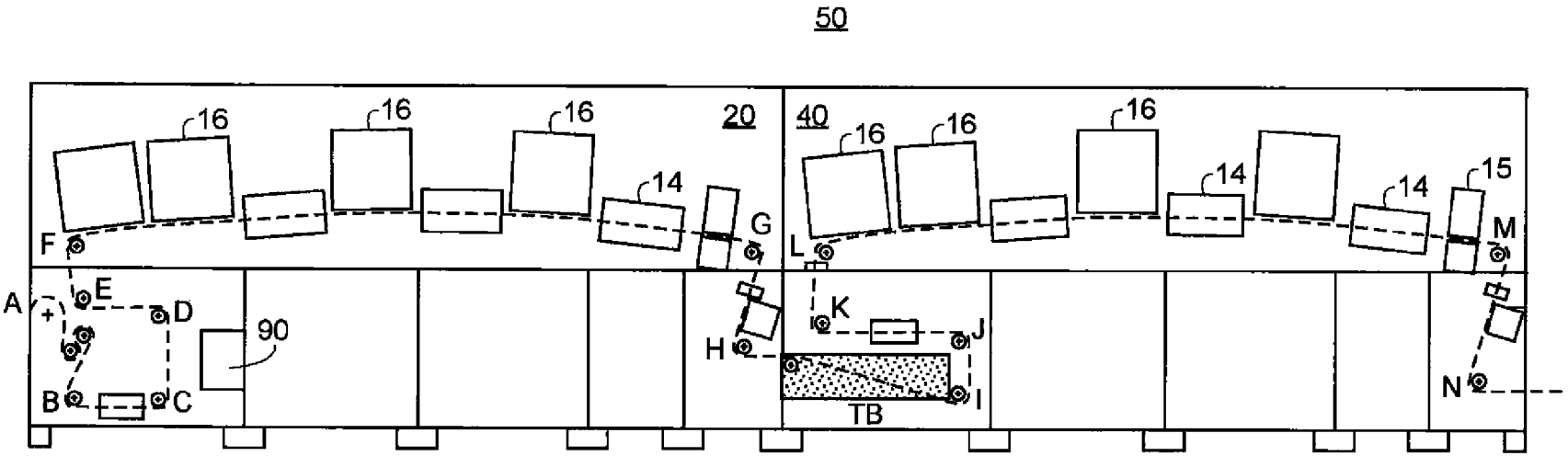
FIG. 2 is a schematic side view of a digital printing system according to an alternate embodiment of the present invention.

Referring to the schematic side view shown in FIG. 2, a digital printing system 50 includes a considerably longer print path than that shown in FIG. 1, but provides the same overall sequence of angular constraints with a lateral constraint at A and with a similar overall series of gimbaled, castered, and fixed rollers and supports shown at positions B through N. Printing system 50 also includes a turnover module TB. Control logic for the appropriate in- and out-feed driver rollers at B and N, respectively, can be provided by an external computer or processor, not shown in FIG. 2. Optionally, an on-board control logic processor 90, such as a dedicated microprocessor or other logic circuit, is provided for maintaining control of web tension within each tension-setting mechanism and for controlling other machine operation and operator interface functions. Printing system 10 and printing system 50 have been described in more detail in at least one of commonly-assigned U.S. patent application Ser. No. 12/627,032 filed Nov. 30, 2009 entitled "MODULAR MEDIA TRANSPORT SYSTEM", by DeCook et al. or commonly-assigned U.S. patent application Ser. No. 12/627,018 filed Nov. 30, 2009 entitled "MEDIA TRANSPORT SYSTEM FOR NON-CONTACTING PRINTING", by Muir et al.

Figure 3:
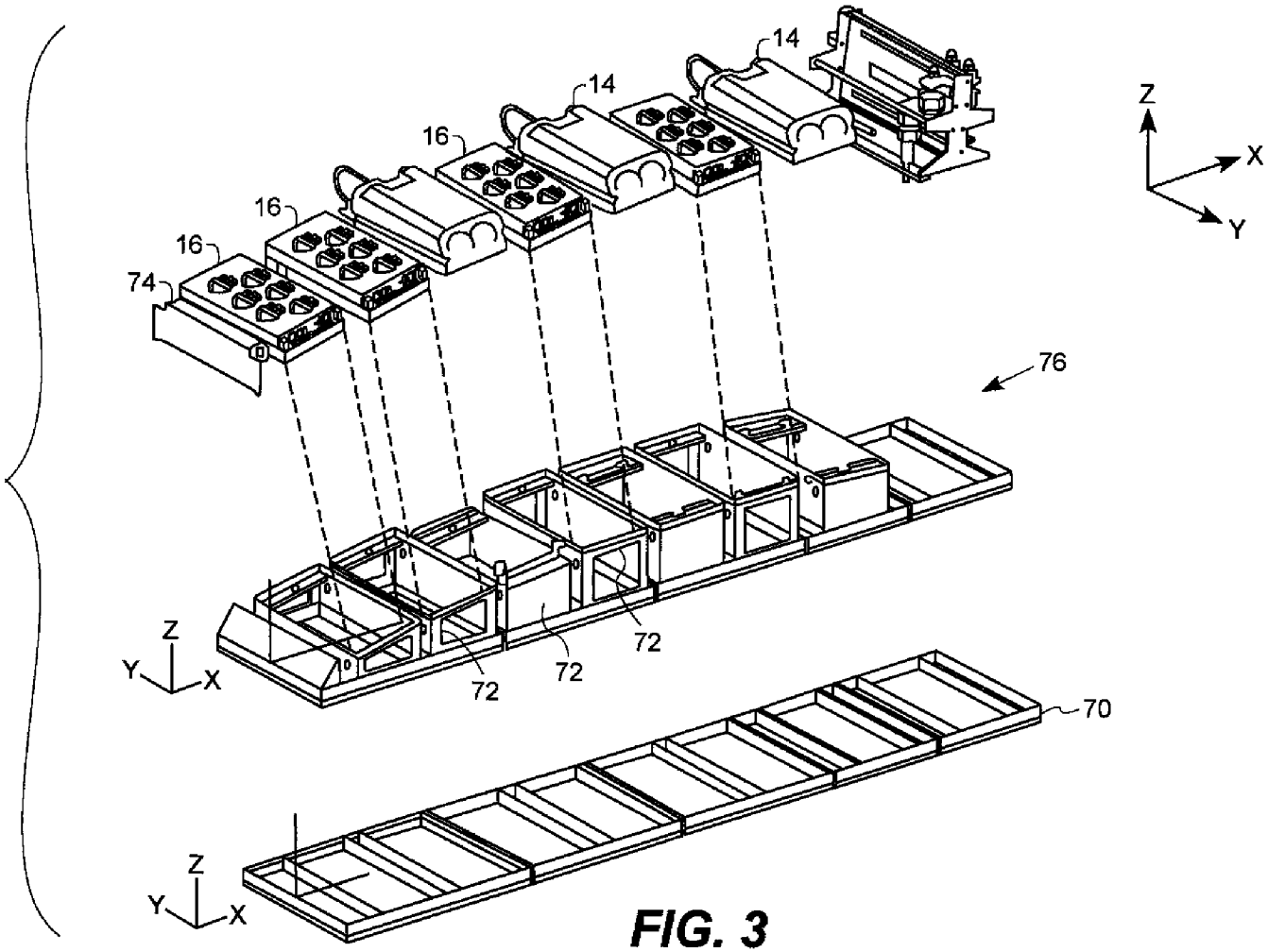
FIG. 3 shows an exploded view of an arrangement of printer components along the printing path, such as those used in the FIG. 1 or 2 embodiment.

Concerns related to thermal expansion can be appreciated for printing systems in general, for example, those printing systems shown in FIG. 1 and FIG. 2 or other types of printing systems. FIG. 3, for example, shows an exploded view of an arrangement of digital printhead assemblies 16, dryers 14, and a support apparatus such as one that can be used for module 20 or 40 in the FIG. 2 embodiment. An example of a support apparatus includes inspection unit 15. In a frame assembly 76, a frame 70 supports a number of pans 72, mechanically fixed with respect to frame 70 and configured to seat digital printhead assemblies 16, dryers 14, rollers 74, and other components along the print path. Since frame 70 can be a few meters or more in length and dot-to-dot registration for digital printing is measured in microns ($10^{-6}$ m), some compensation is needed so that frame 70 expansion or contraction with temperature does not noticeably affect printing registration.

Figure 4:
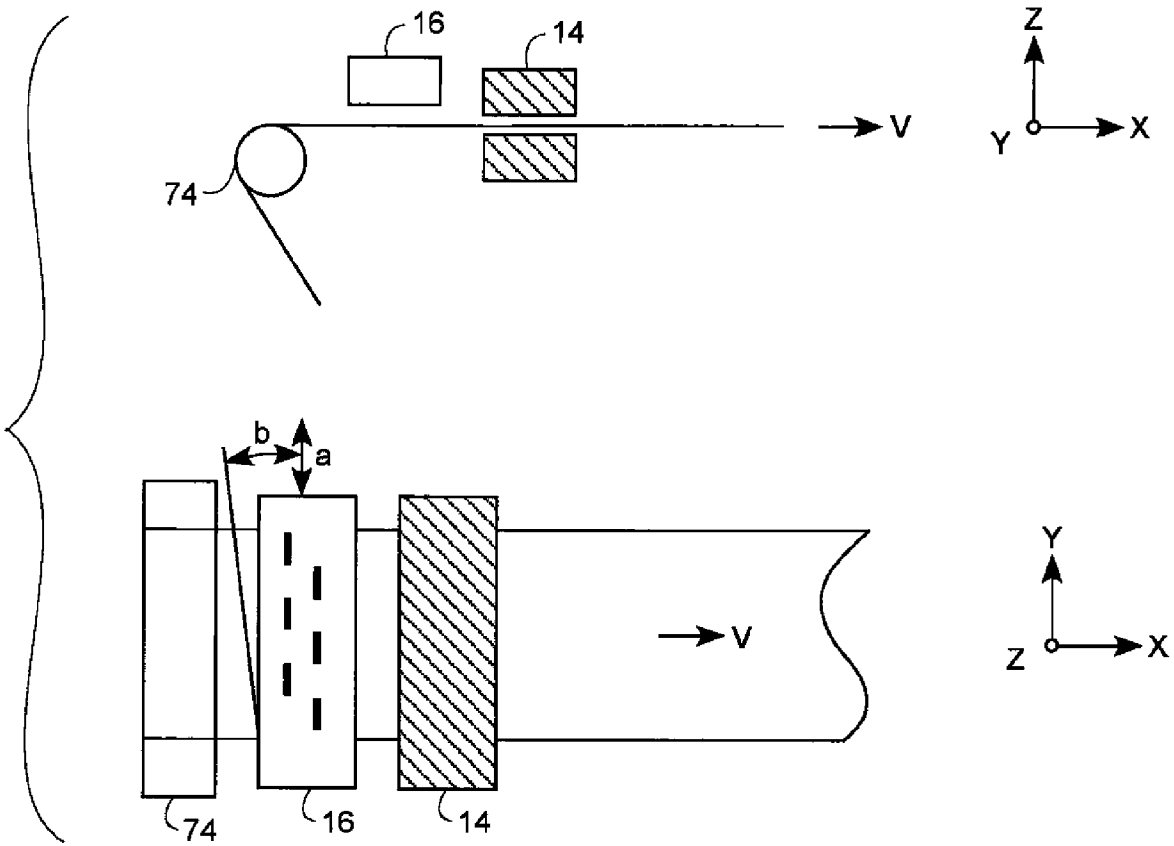
FIG. 4 is a schematic diagram that shows, from side and top views, printer components in a portion of the printing path for either FIG. 1 or FIG. 2 embodiments.

Thermal expansion and contraction can impact registration both along the length of the web (x axis direction) and in the cross-track direction (y axis direction). The schematic view of FIG. 4 shows, from side and top views, components in a portion of the printing path for either FIG. 1 or FIG. 2 embodiments. As shown, cross track alignment for digital printhead assembly 16 must be constrained at a, in the y axis direction. Within the plane of digital printhead assembly 16, rotation or skew, shown as angle b, must also be constrained. There are no registration requirements for dryer 14.

Figure 5:
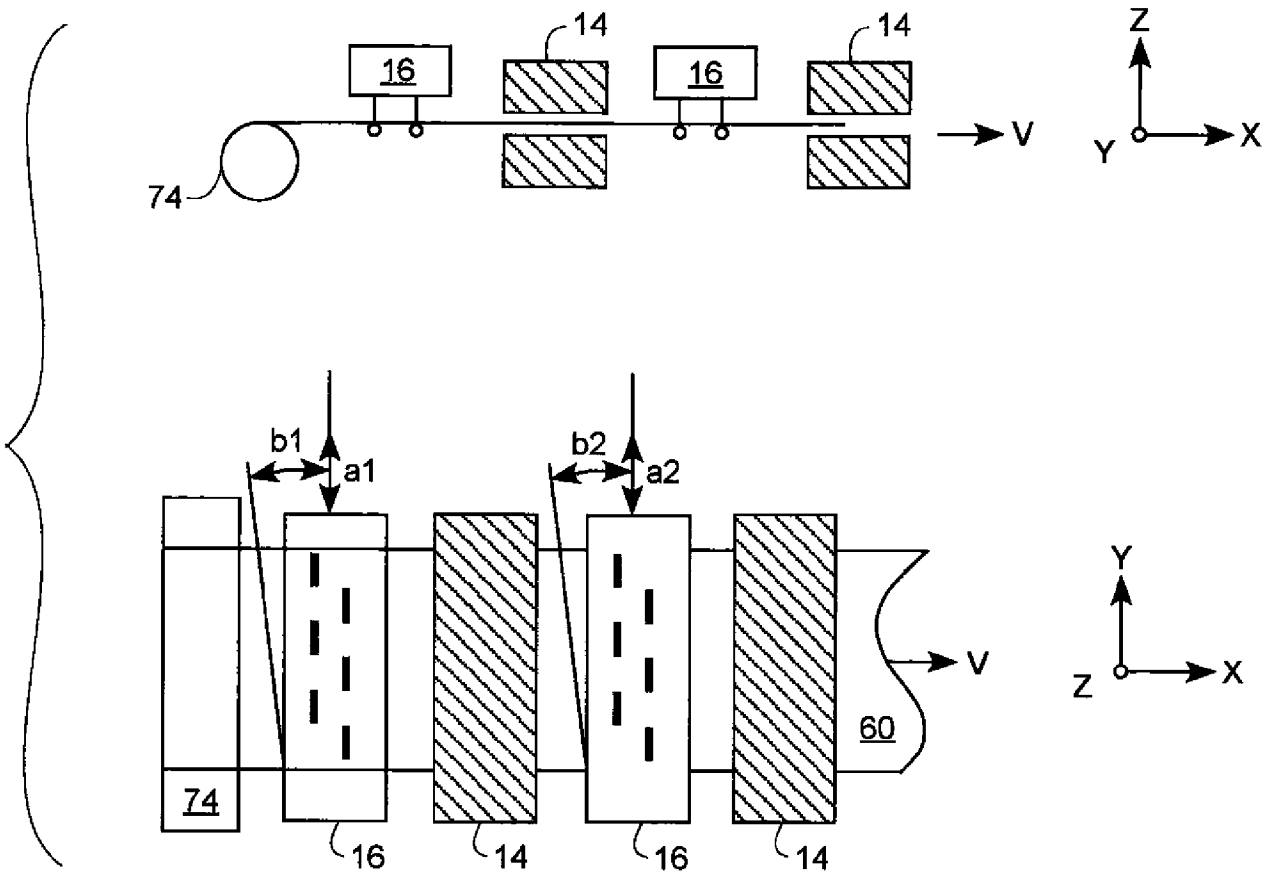
FIG. 5 is a schematic diagram that shows, from side and top views, a printing path having additional printer components.

The schematic diagram of FIG. 5 shows how the registration problem becomes more complex where there are multiple printer components that must be registered to each other, such as for multiple digital printhead assemblies 16. Thermal expansion can cause the spacing between the printhead assemblies to change which can cause the printed image from the second printhead to not register properly with the printed image from the first printhead. If the thermal expansion isn't uniform from one side of the web to the other, thermal expansion can cause one printhead assembly to skew relative to the other printhead assembly. If both digital printhead assemblies 16 are skewed at the same angle (that is, angle b1=b2), correct registration between the printheads can be maintained along the y axis direction. However, if the two digital printhead assemblies 16 exhibit angular skew with angles b1 and b2 in opposite directions, it becomes very difficult to align dots between the two printhead assemblies across the width of the print media. As such, it is desirable to register the print from different printhead assemblies in the in-track direction (in the direction of paper motion) and in the cross track direction (perpendicular to the direction of paper motion). It should be noted that some cross-track correction is possible where linear printing arrays are employed in digital printhead assembly 16. Cross-track adjustment can be done in full pixel increments, when only a portion of the printhead arrays are allocated for printing by shifting the portion allocated for printing over by one or more pixels. However, angular skew cannot be compensated in this manner.

Figure 6:
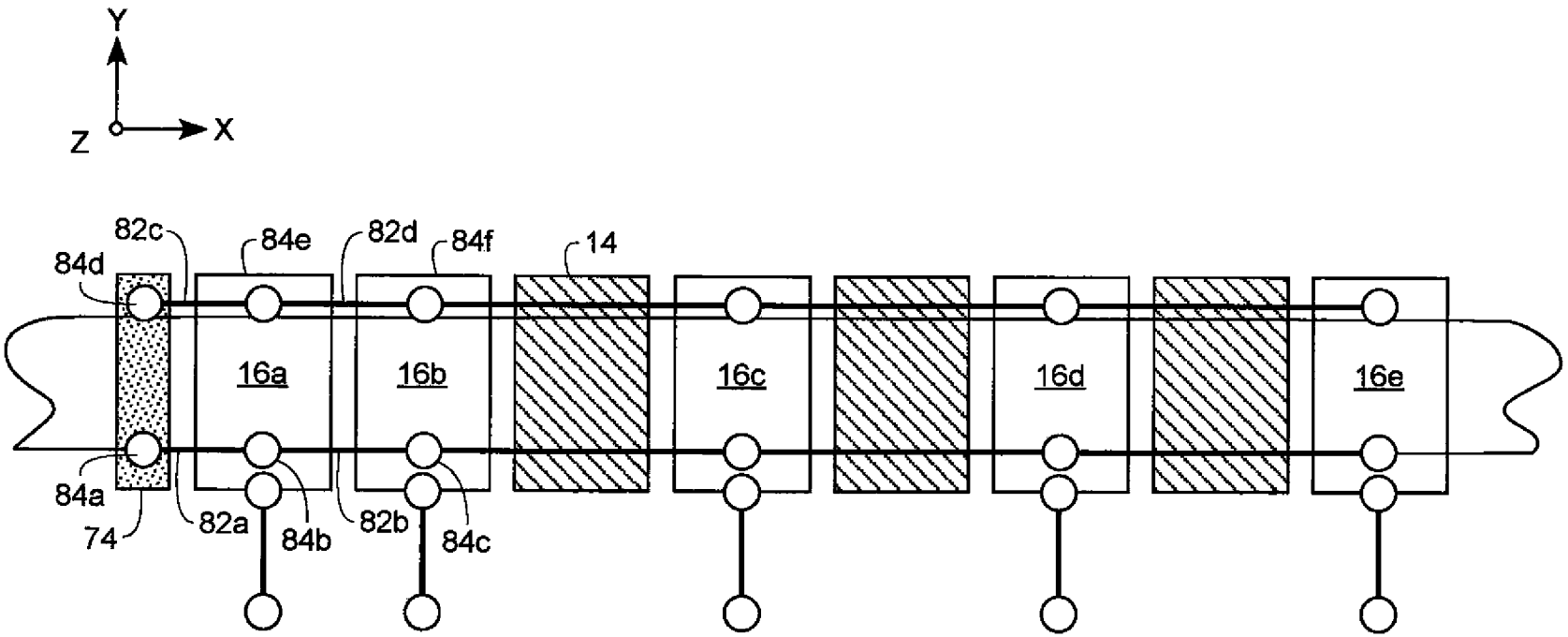
FIG. 6 is a schematic diagram showing a constraint pattern for printer components.

The schematic diagram of FIG. 6 shows a pattern of constraints that are needed in order to prevent angular skew, as described with reference to angles b1 and b2 in FIG. 5 and to provide cross-track constraints (a1 and a2 in FIG. 5). In the arrangement shown, the digital printhead assemblies 16 are joined by the network of constraints. Dryers 14 (which need not be critically aligned), meanwhile, are independent of the constraint arrangement. Roller 74, mounted to frame 70, serves as a first, or reference printer component. Roller 74 is typically located in the media path just prior to the first printhead in the printing zone, such as rollers F in the first module 20 and roller L in the second module 40 shown in FIG. 2. An encoder for tracking or monitoring the motion of the print media, as it moves through the printing system, is commonly employed at roller 74. The print media, moving through the printing system, moves perpendicular to roller as it leaves roller 74. Printhead assembly 16*a*, is spaced away from roller 74 by beams 82*a* and 82*c*. Beam 82*a* is coupled to a first printer component, roller 74 as shown in FIG. 6, at coupling 84*a* and to a second printer component, printhead 16*a* as shown in FIG. 6, at coupling 84*b*. Similarly beam 82*c* is coupled to roller 74 at coupling 84*d* and to printhead 16*a* at coupling 84*e*. If the spacing between the couplings 84*a* and 84*d* equals the spacing between couplings 84*b* and 84*e*, and the length of beam 82*a* equals the length of beam 82*c*, then printhead 16, roller 74, and beams 82*a* and 82*c* form the sides of a parallelogram, assuming the couplings lie in a plane. The parallelogram can form a rectangle with a properly chosen lateral constraint 88 on printhead 16*a*. In a similar manner, printhead 16*a* and printhead 16*b*, and beams 82*b* and 82*d* can be made to form a rectangle. In this manner, one can ensure that the printheads are appropriately aligned parallel to each other and perpendicular to the print media moving past them. It should be noted that this method for ensuring that the parallel alignment of the printheads works even when printheads do not all lie in a common plane.

Although roller 74 is described above as being the first printer component and printhead 16*a* is described as being the second printer component, these designation are not limited to roller 74 and printhead 16*a*. For example, printhead 16*a* can be referred to as the first printer component and printhead 16*b* can be referred to as the second printer component. Other designations or configurations of the first printer component and the second printer component are also permitted.

Figure 7:
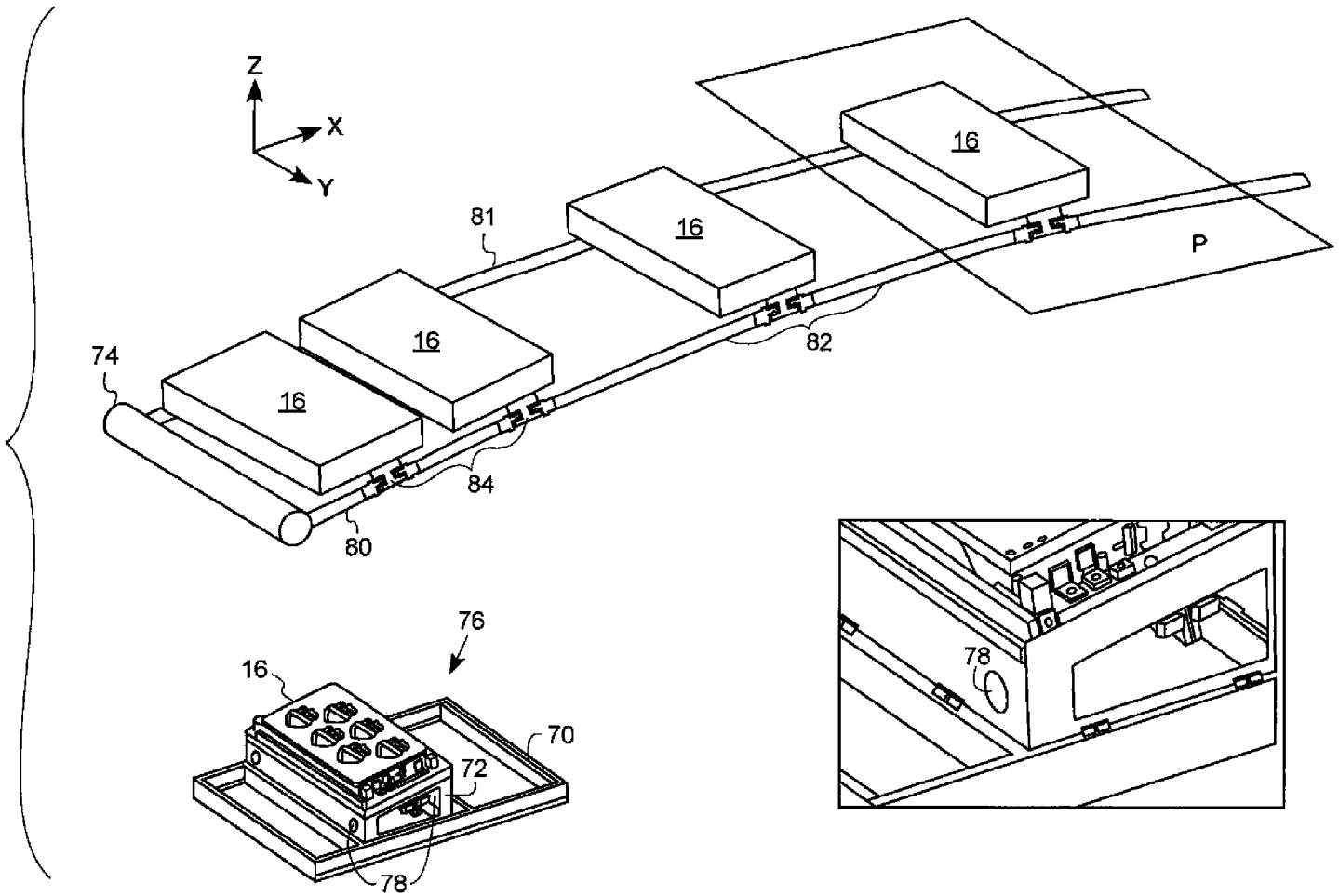
FIG. 7 is a perspective view showing an arrangement of alignment mechanisms for printer components in one embodiment.

The perspective views of FIG. 7 show how the constraint pattern of FIG. 6 is provided according to one embodiment. Alignment mechanisms 80 and 81 are kinematically coupled to each printer component. In the embodiment shown, the spacing between each printhead assembly 16 defined by elements of the first and second alignment mechanisms 80 and 81. As both first and second alignment mechanisms 80 and 81 are similarly constructed, the description of alignment mechanism 80 that follows applies equivalently to alignment mechanism 81, with some possible differences in coupling components, as described subsequently.

By defining printer component spacing in this manner, sensitivity to stresses on frame 70 is reduced. As such, lighter frame construction (as compared to conventional frame construction) can be used which helps reduce at least manufacturing costs and shipping costs.

With respect to the partial view of FIG. 7, these printer components include roller 74 and four digital printhead assemblies 16. Alignment mechanism 80 has a series of beams or sections 82 joined by couplings 84 that link kinematically to each digital printhead assembly 16. Alignment mechanism 80 is shown as a series of modular assemblies, simplifying the interconnection of printer components in various arrangements and at various distances from each other. Alternately, alignment mechanism 80 can be a continuous structure that extends the length of the printing system, such as the length of frame assembly 76 (FIG. 3).

The alignment mechanisms 80 and 81 are used to define the spacing between various printer components that are aligned relative to each other, for example, rollers or printhead assemblies. While the alignment mechanisms 80 and 81 are used to define the spacing between various printer components, the alignment mechanisms do not support the printer components. The printhead assemblies, dryers, and other components are secured to and supported by other structures, for example, pans 72 as shown in FIG. 3. In order to permit the alignment mechanism to define the spacing between the aligned printer components, the printer components are compliantly mounted to frame assemblies 76 that are each secured to one of pans 72. The compliant mount allows the printer component to move freely within a plane. An example embodiment of a compliant mount 77 is shown in FIG. 10B and FIG. 10C.

Figure 10A:
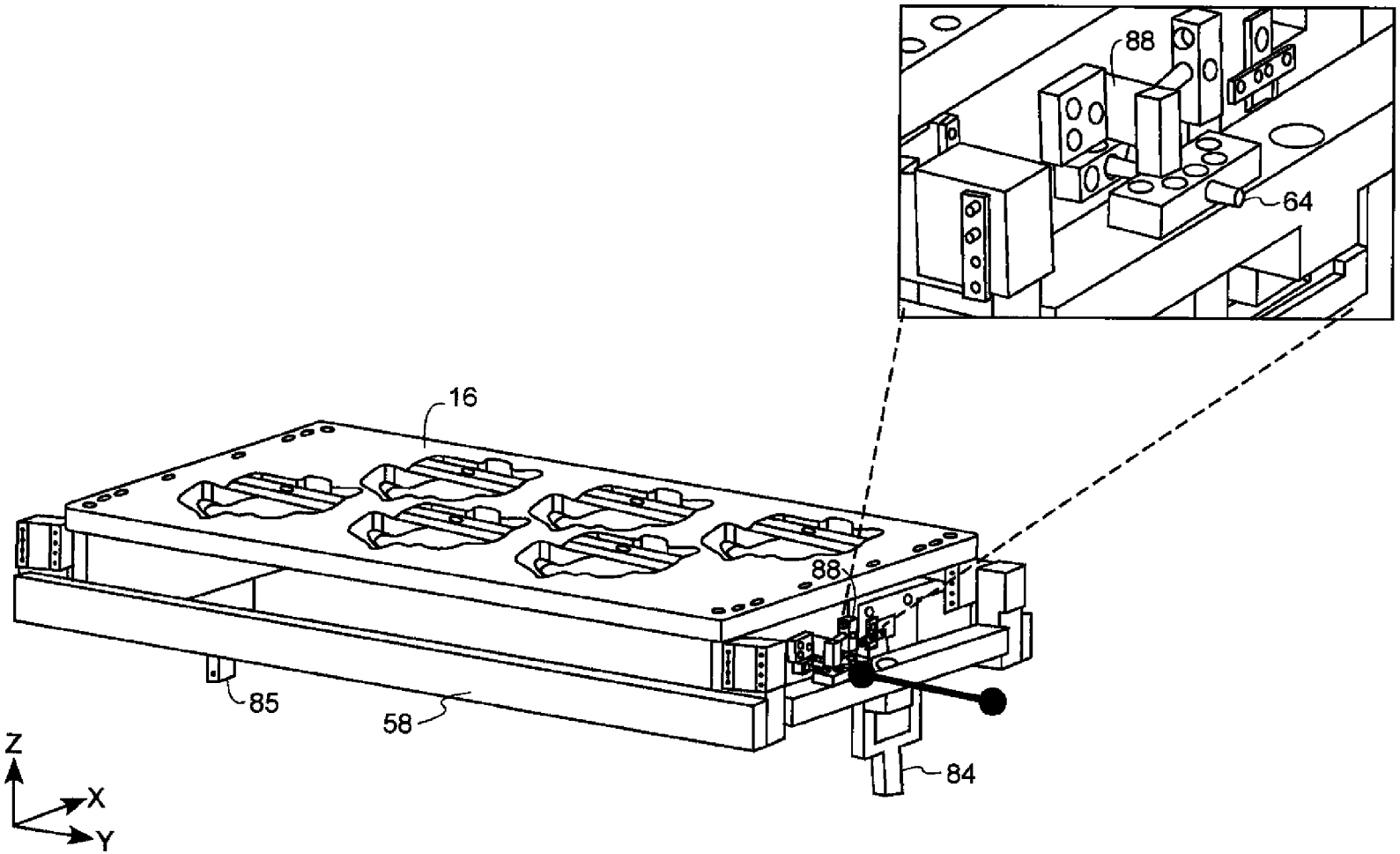
FIG. 10A is a perspective view that shows cross-track adjustments for the printhead assembly of FIG. 9.
Figure 10B:
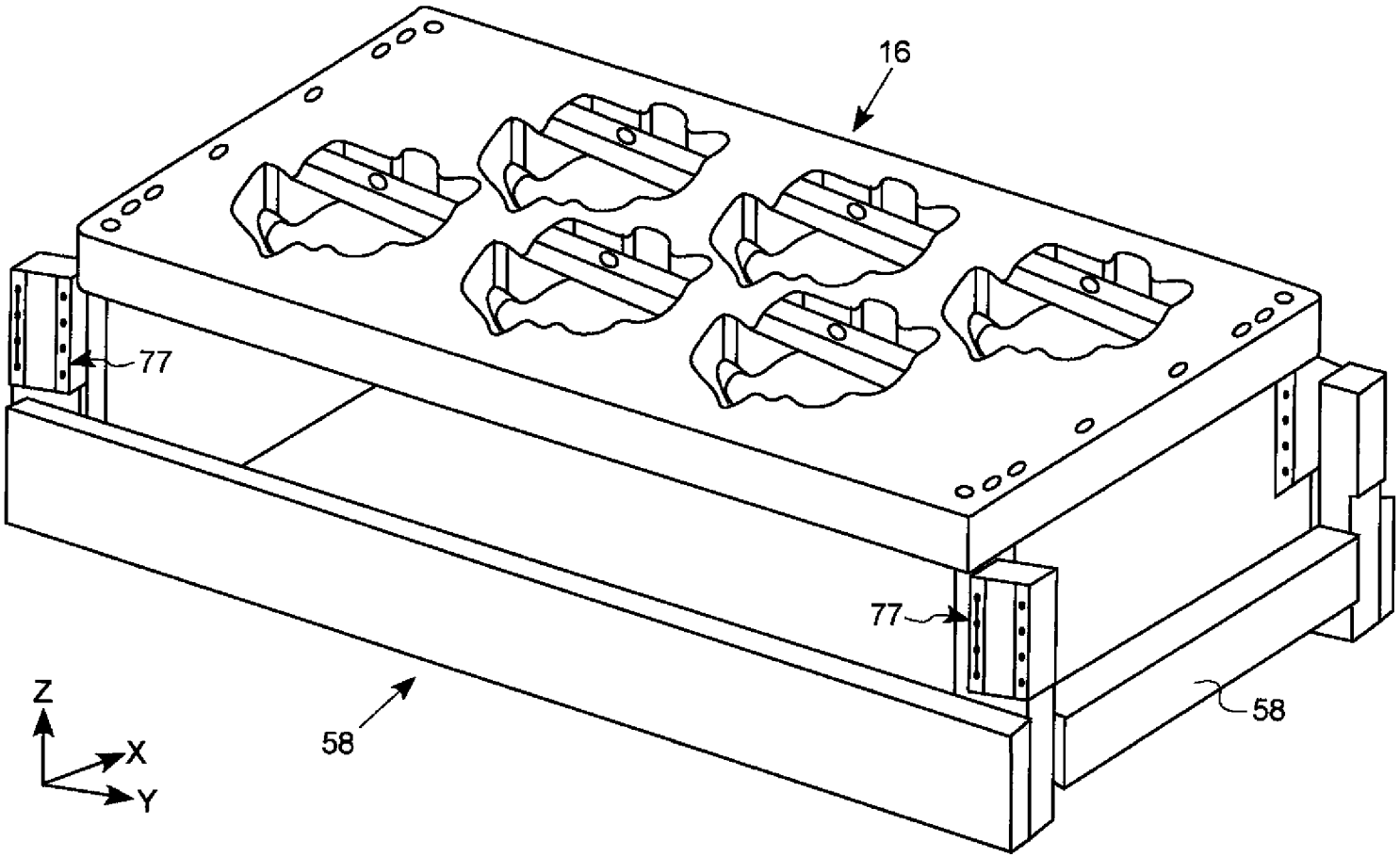
FIG. 10B is an enlarged perspective view of a portion of FIG. 10A that shows compliant mounts for the printhead assembly of FIG. 9.
Figure 10C:
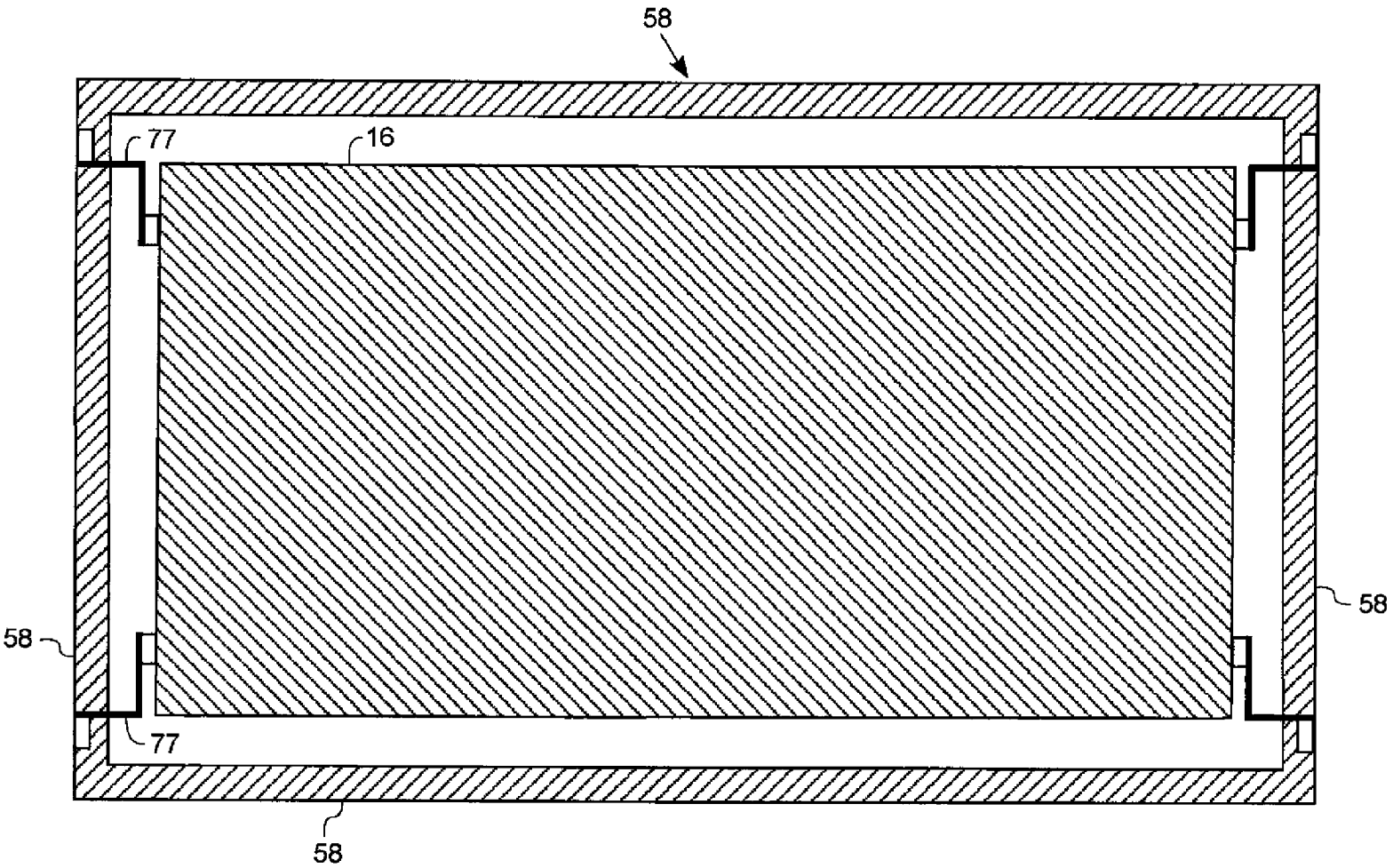
FIG. 10C is a schematic top view of the compliant mounts shown in FIG. 10B.

Referring to FIGS. 10B and 10C, a printhead assembly base plate, which is a portion of a digital printhead assembly, is shown. It has a plurality of receptacles for receiving and securing a plurality of jetting modules (not shown in FIG. 10B). Compliant mounts 77 (flexure structures as shown in FIGS. 10B and 10C) couple each corner of the base plate to the component support tray 58. L-shaped flexures are shown, though other flexure structures or non-flexure structures can be used as compliant mounts 77. The flexures allow the plate to move freely within the x-y plane, including rotations around the z axis, while impeding motion in z direction.

The media path can include a plurality of rollers or web guides under the media that cause the media to move along a portion of an arc, as shown in FIG. 2. This concept, causing the media to move over a portion of an arc, has also been described in U.S. Pat. No. 6,003,988. The orientation of printhead assemblies that print at various locations along the arc tends to vary so that the printhead assembly is oriented approximately parallel to the local plane of the print media. To provide for the varying tilt of the printhead assemblies, the upper surface of the individual pans 72 to which the frame assembly are secured have varying heights and tilt angles. The compliant mount 77 of the various printhead assemblies preferably allows each printhead assembly to move freely within the plane parallel to that printhead assembly. Therefore, in a printing system having multiple printhead assemblies or printer components, one of those printer components can be compliantly mounted to allow the component to be free to move in a first plane, while another printer component is free to move in a second plane. This allows the spacing between the printheads to be defined by the first and second alignment mechanisms without causing the spacing between a printhead and the print media, passing under it, to be affected by the first and second alignment mechanisms.

As shown in FIG. 7, pans 72 include holes 78 through which the beams 82 can pass freely. Because of the overall kinetic mounting arrangement that is used, each printer component is allowed movement within its respective plane P and can be adjusted to a suitable position over its range of movement within its plane P. As shown in FIG. 7, the respective plane for one printer component may not be in parallel with the plane of another. Portions of pan structure 72, for example, pan ledges 110 (shown in FIG. 15) serve as shields that shield alignment mechanisms 80 and 81 from heat sources, for example, dryers 14. This shielding helps to reduce the thermal expansion variations that can be caused by dryers 14.

Figure 8:
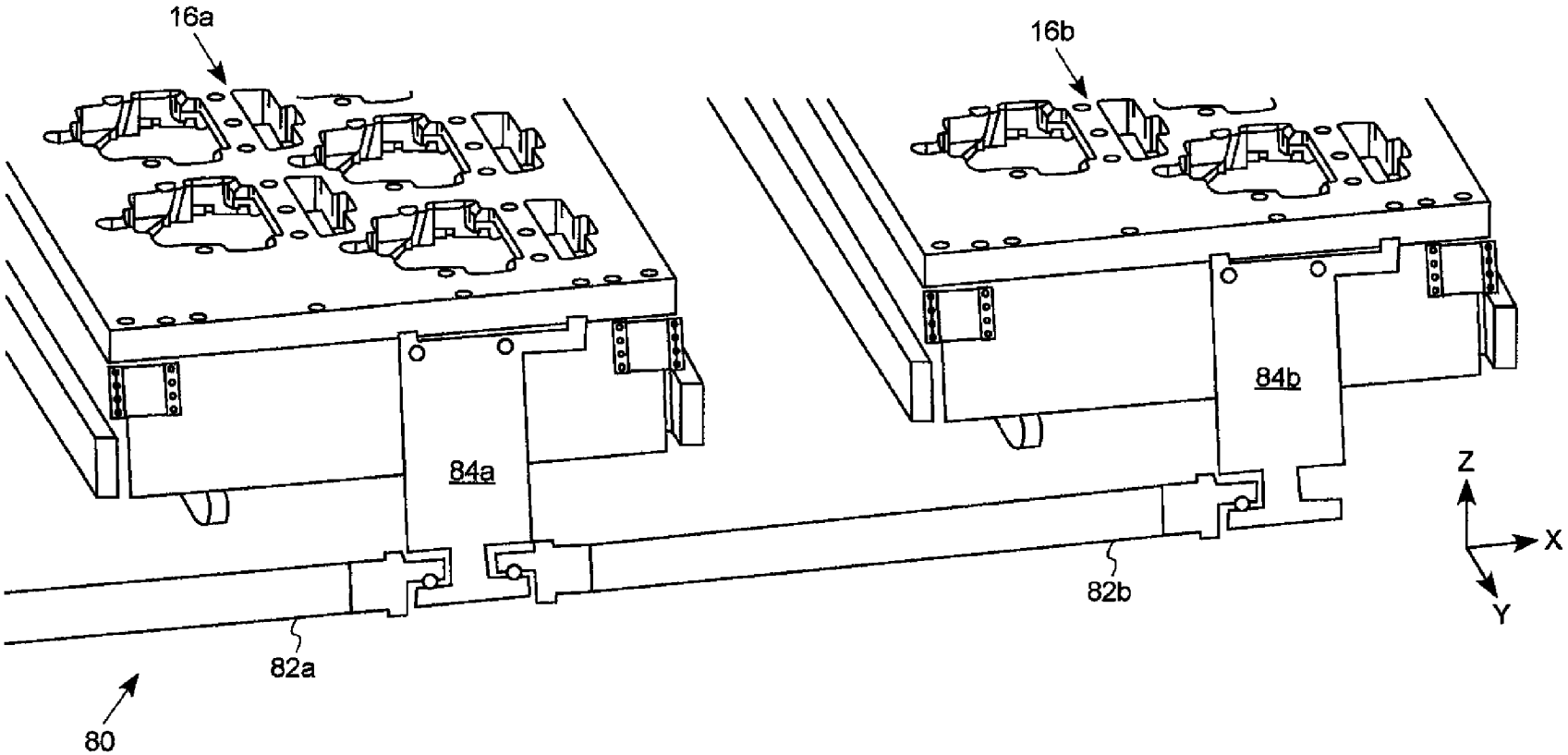
FIG. 8 is a perspective view from the side showing components of an alignment mechanism in one embodiment.

The perspective view of FIG. 8 shows couplings 84 of alignment mechanism 80 in more detail. The pans 72 and portions of the frame assembly 76 have been omitted to enable the coupling 84 between the printer components (printhead assembly base plates in this figure) to be seen with more clarity. Couplings 84 are attached to the printhead assemblies 16. The couplings 84 link to sections 82 of the alignment mechanism 80. Coupling 84*a* is shown linking to both an upstream section 82*a* and a downstream section 82*b*. Coupling 84*b* is linked only to an upstream section 82*b*; this corresponds to the coupling for the final printhead assembly in a printer module.

Figure 9:
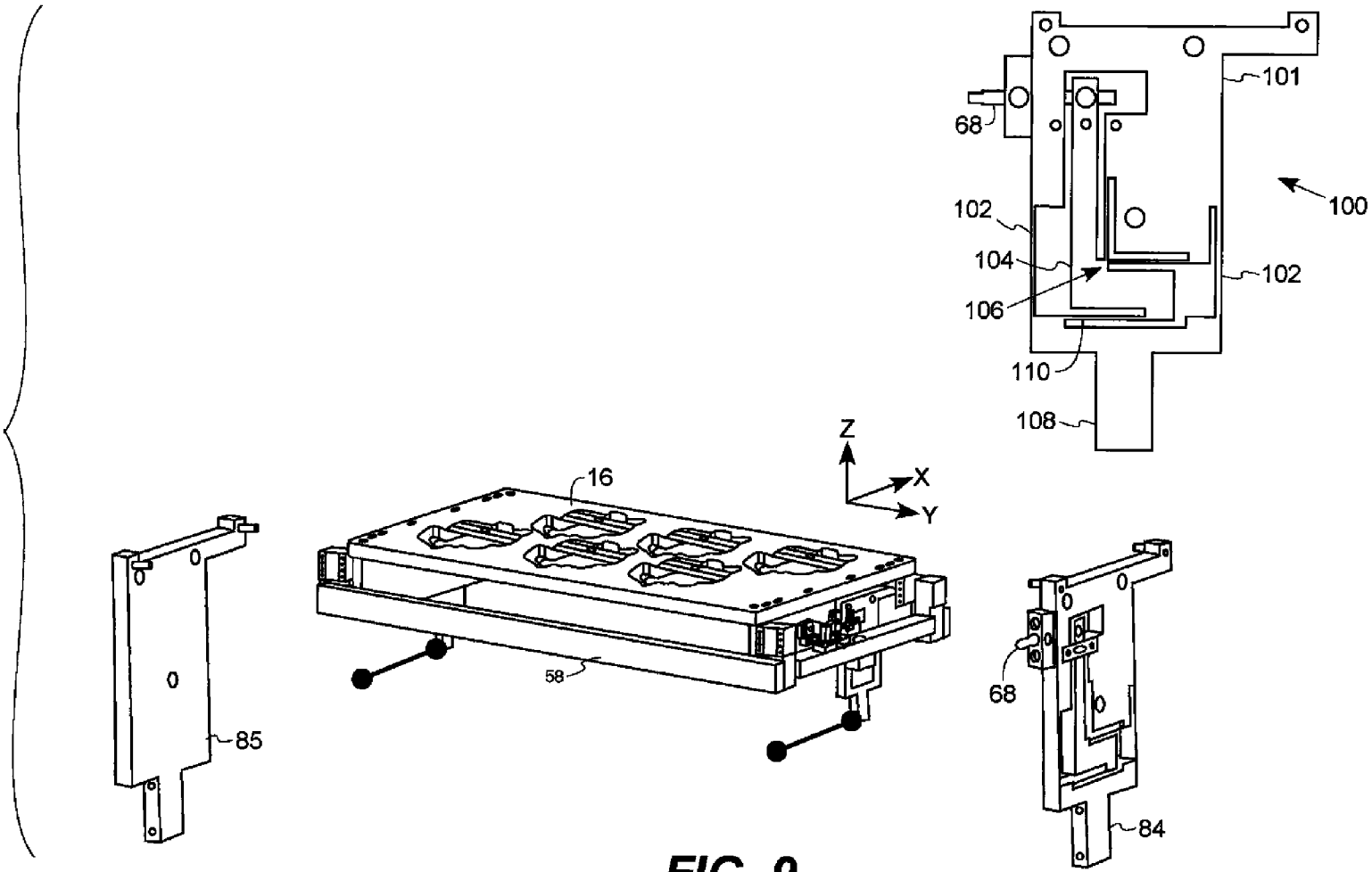
FIG. 9 is a perspective view that shows a printhead assembly mounted within its frame.

The perspective view of FIG. 9 shows the constraint pattern that applies for compliant mounting of digital printhead assembly 16 within the frame using coupling 84 as part of alignment mechanism 80 and coupling 85 as part of alignment mechanism 81. In the embodiment shown, coupling 84 is an adjustable coupling 120. The upper portion 121 of the coupling is secured to the printhead assembly 16, and the arm 128 gets coupled to the alignment mechanism 80. The arm 128 is connected to the upper portion 121 by means of flexures 122. An adjustment mechanism 68, shown here as a screw, moves the end of level 104. Lever 124 pivots around fulcrum 126. As the distance from the fulcrum to the adjustment mechanism is three times the distance from fulcrum to the bottom of the lever where is pushes against the arm by means of flexure 130, this adjustment mechanism provides a 3 to 1 displacement ratio between the tip of the lever 124 at the adjustment mechanism and displacement of the arm 128 After an adjustment has been made using the adjustable coupling 120, clamping plate 132, shown in FIG. 13, can be secured with screws (not shown) to the lever 124 and the upper portion 121 to lock in the adjustment. The adjustable coupling 120 is available in order to adjust the angular orientation of digital printhead assembly 16 provided by an adjustment mechanism 68; coupling 85 is not adjustable in this embodiment. A ball plate arrangement is used to seat digital printhead assembly 16 to tray 58 without overconstraint.

The perspective view of FIG. 10A shows an adjustment mechanism to provide an adjustment of the cross track position, y-direction position. In this embodiment, an adjustment mechanism 64, shown here as a screw threaded into block 56 on the component support tray 58, pushes against the printhead assembly 16 provided to allow adjustment of cross-track position in the y direction. When adjustment mechanism 64 is a screw, it is preferably a differential screw to provide a high resolution adjustment means. With the printhead assembly appropriately positioned in the cross track by means of the adjustment mechanism, the cross track position can be secured by clamping one end of flexure coupling 88 to the printhead assembly 16 and the other end to component tray 58. Flexure coupling 88 allows serves as a lateral constraint for the printhead assembly 16 relative to the component support tray 58 and the frame assembly 76 to which the component support tray 58 is secured. (shown in FIG. 3). Flexure coupling 88, while providing a lateral constraint on the printhead assembly does not constrain the printhead in the in-track or x axis direction. The flexure coupling 88 should be made sufficiently long so that motion in the x direction over the expected range does not produce unacceptable shifts in the y direction position.

Manipulation of either or both of adjustment mechanism 64 and adjustment mechanism 68 can be accomplished manually or in an automated manner. When manipulation of either or both of adjustment mechanism 64 and adjustment mechanism 68 is accomplished in an automated fashion, it can occur automatically in response to a change in operating conditions or in response to signals sent by a device that monitors an aspect of the printing operation, for example, print registration, as described in German Patent Application No. 102009039444.3, filed Aug. 31, 2009, entitled "ADAPTIVE STITCH METHOD", by Schluenss et al.

Figure 11A:
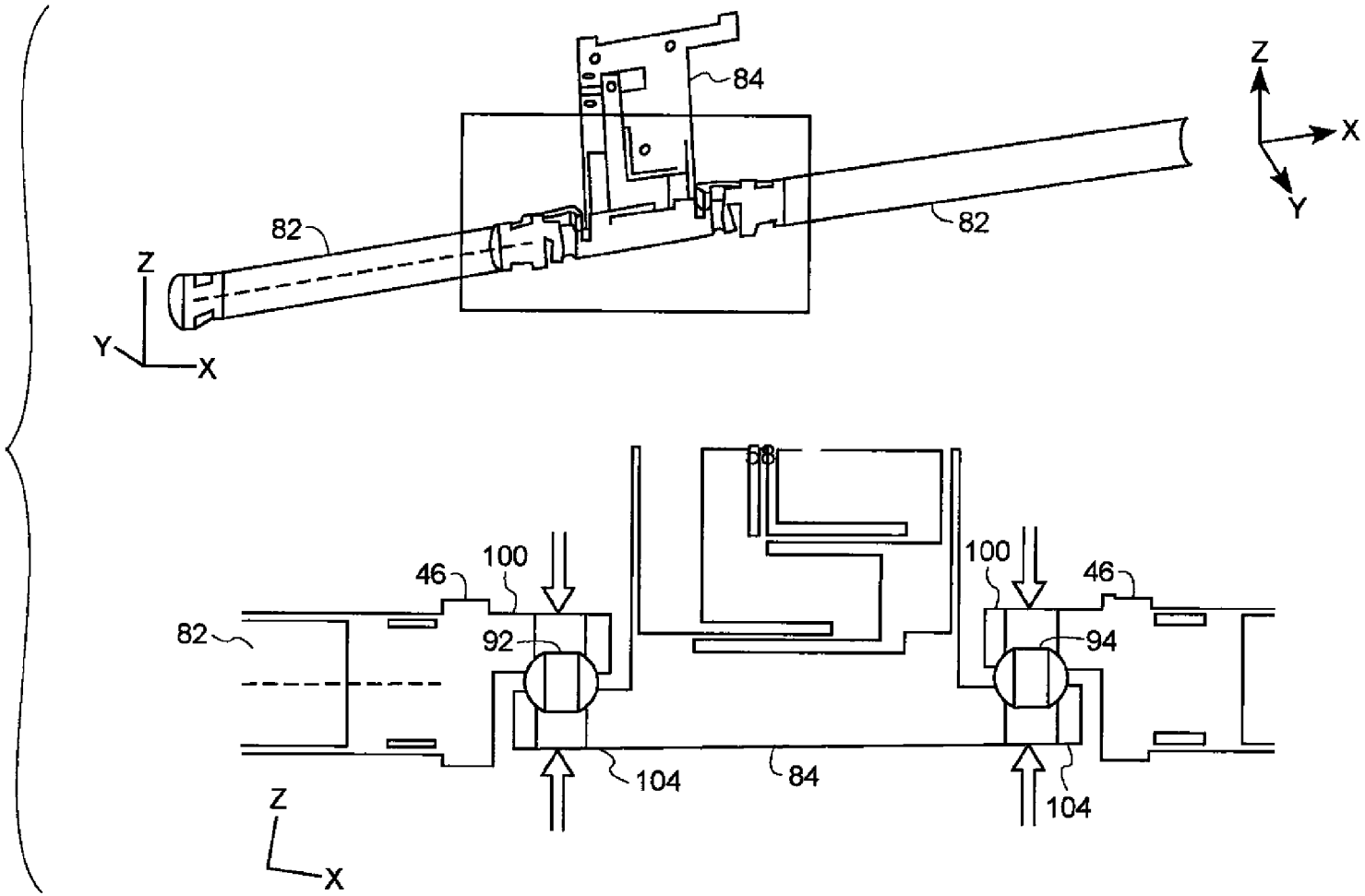
FIG. 11A shows perspective and side views of an example embodiment of a coupling arrangement for an alignment mechanism.
Figure 11B:
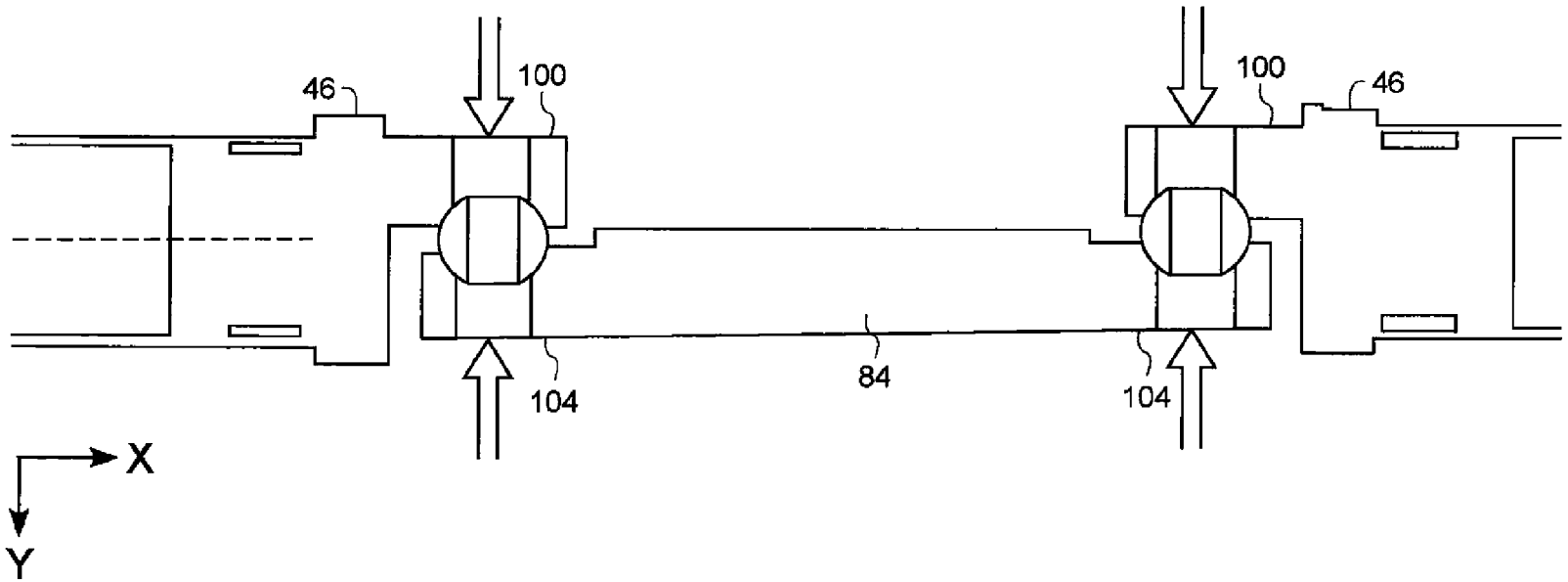
FIG. 11B shows a bottom view of another example embodiment of a coupling arrangement for an alignment mechanism.

FIG. 11A shows perspective and side views of an example embodiment of joints 92 and 94 for each coupling 84. FIG. 11B shows a bottom view of another example embodiment of joints 92 and 94 for each coupling 84. In FIG. 11A, fasteners 108 (represented by arrows in this figure), for example, bolts, of joints 92 and 94 are located in the xz plane and are substantially perpendicular to frame 70 (see, for example, FIG. 7). This configuration of joints 92 and 94 permits rotation of sections 82 of alignment mechanisms 80 and 81 about the z axis and some rotation about the y axis. In FIG. 11B, joints 92 and 94 and coupling 84 have been rotated 90 degrees relative to each other as compared to their respective locations as shown in FIG. 11A. In FIG. 11B, coupling 84 extends into the figure. Fasteners 108 (represented by arrows in this figure), for example, bolts, of joints 92 and 94 are located in the xy plane and are substantially parallel to frame 70 (see, for example, FIG. 7). This orientation of joints 92 and 94 permits some rotation about the z axis and increased rotation of sections 82 of alignment mechanisms 80 and 81 about the y axis when compared to the orientation of joints 92 and 94 as shown in FIG. 11A and is well suited for implementation in a printing system that includes an arced media path (see, for example, FIG. 2).

Figure 12:
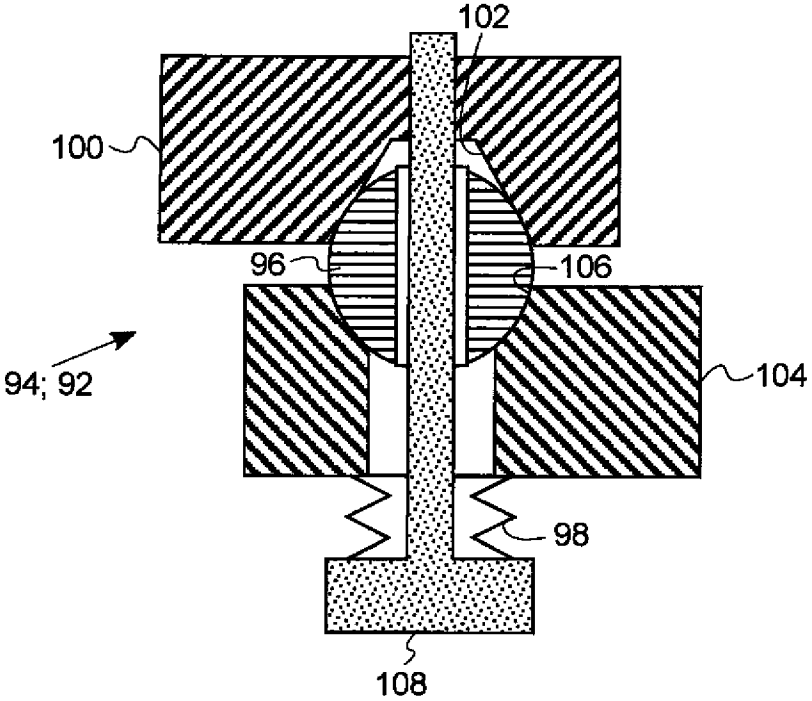
FIG. 12 is a cross-sectional view of a joint in one embodiment.

The cross-sectional view of FIG. 12 shows an example embodiment of joint 92 or joint 94 that includes, for example, a ball joint 96 that is loaded with a spring 98. The end of section 82 includes a cap 46. Cap 46 has an arm 100 with a tapered recess 102 for engaging ball 96. Coupling 84 also has an arm 104 with a similar tapered recess 106 for engaging ball 96. The joint is held together with a fastener 108, for example, a bolt, that passes through clearance holes in arm 104 and ball 96 and is screwed into arm 100. Alternatively, arm 100 can also have a clearance hole for the fastener 108, and a nut, or another type of fastener retaining mechanism, can be used to secure the fastener in place. Spring 98, constrained between the head of fastener 108 and arm 104, holds the tapered recesses 102 and 106 of arms 100 and 104 firmly in contact with ball 96. This joint provides a kinematic coupling between the coupling 84 and section 82, having zero backlash between the sections 82 and the coupling 84 while allowing the section 82 to pivot freely, within a range of angles, relative to the coupling 84.

Figure 13:
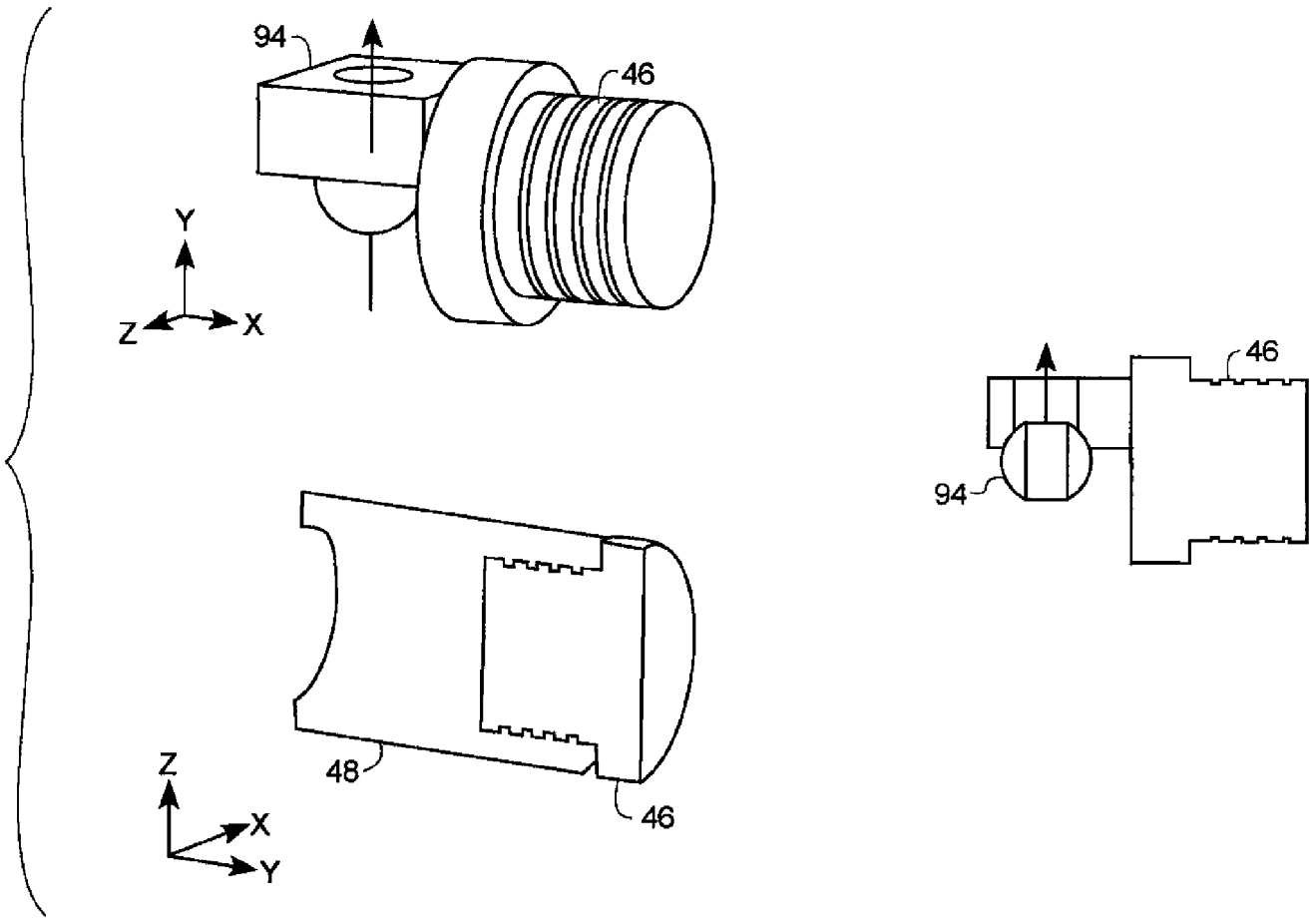
FIG. 13 shows perspective and cross-sectional views of the joint ends of sections in an alignment mechanism for one embodiment.

FIG. 13 shows perspective and cross-sectional views of the joint ends of sections 82 in one embodiment. A cap 46 is glued or otherwise fitted and secured onto the end of a tube 48. The material composition of tube 48 preferably has a low coefficient of thermal expansion (CTE). In one embodiment, first and second alignment mechanisms use tubes 48 of a commercially available carbon fiber composite material with a coefficient of thermal expansion in a range of less than 5 ppm per degree Celsius, preferably less than or equal to 1.1 ppm per degree Celsius. Alternately, other types of tubing or cable can be used. Significantly, because sections 82 use beams formed using tube 48 of the same material, the printer components that are mounted to alignment mechanisms 80 and 81 within the equipment frame behave similarly in response to a change in temperature, moving together in a predictable fashion. Thickness and other dimensions for sections 82 can be different or can be substantially equal.

Figure 14:
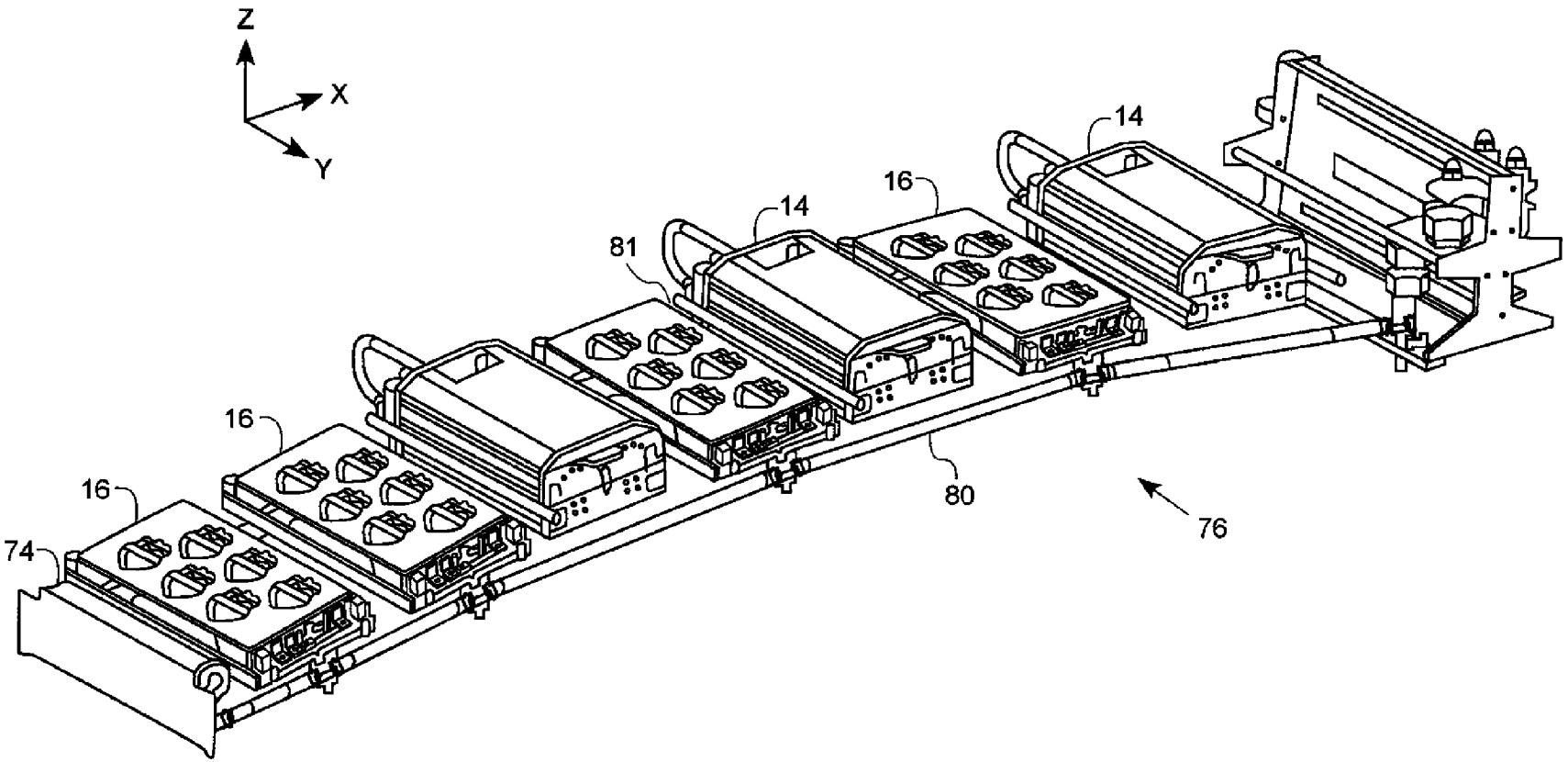
FIG. 14 is a perspective view that shows an assembled alignment mechanism within a printer frame assembly.

The perspective view of FIG. 14 shows an assembled alignment mechanism 80 in one embodiment of the present invention. The frame assembly 76 that supports printheads 16, dryers 14, roller 74 and inspection unit 15 has been hidden to enable the connection between the printhead units 16 and alignment mechanisms 80 and 81. A first printer component, roller 74, is mounted to frame assembly 76. Alignment mechanisms 80 and 81 (partially obscured in the view of FIG. 14) are then kinematically coupled to roller 74 and to each of the digital printhead assemblies 16. Optionally, additional shielding can be used to protect portions of alignment mechanisms 80 and 81 from heat sources. With the constraint arrangement described herein, each digital printhead assembly 16 is allowed a measure of movement within its plane P, as was shown in FIG. 7.

Figure 15:
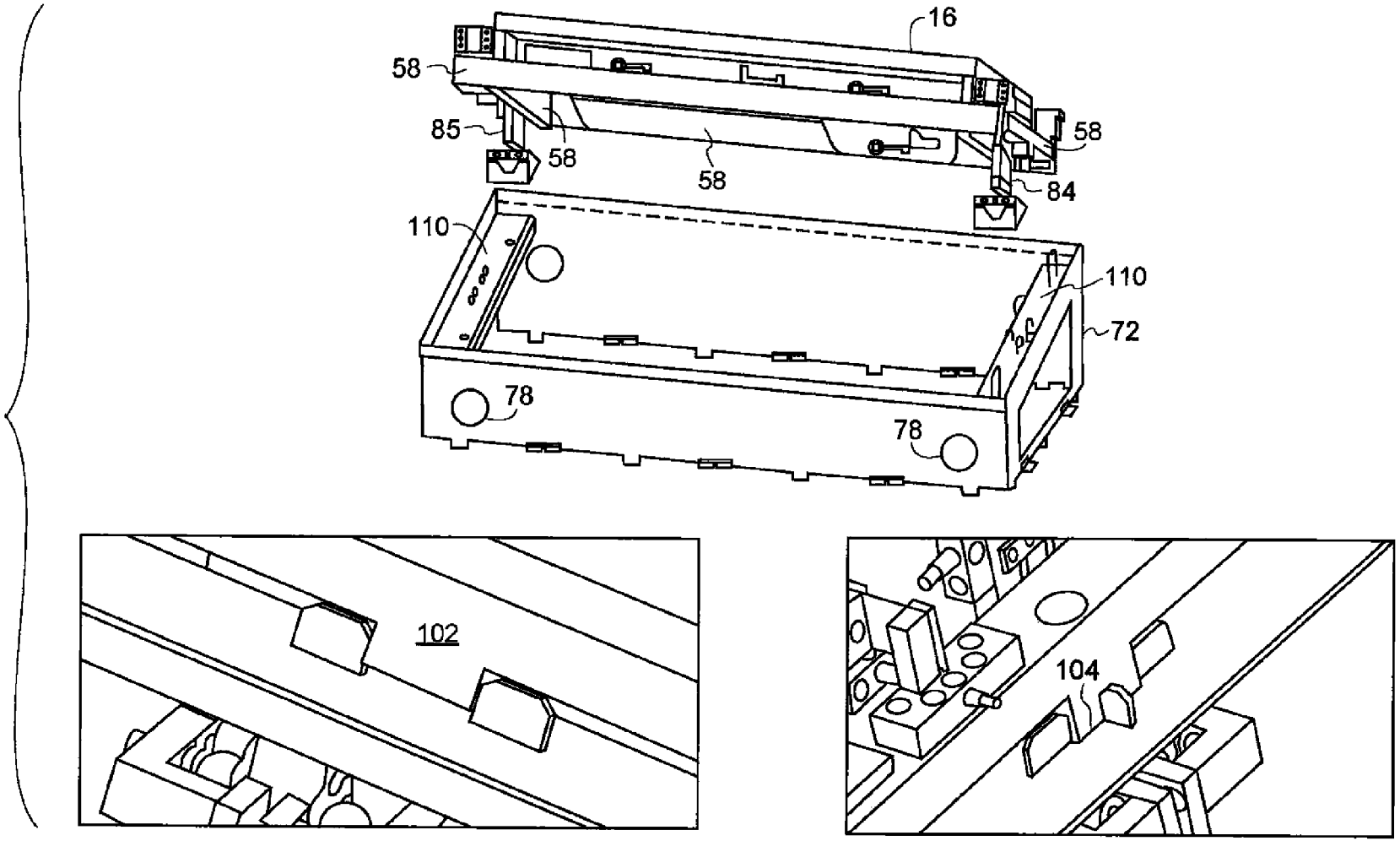
FIG. 15 is perspective view showing assembly details for a printer component according to one embodiment.

Modularity and ease of assembly are among advantages provided by the alignment mechanisms of the present invention. FIG. 15 shows assembly details for seating digital printhead assembly 16, with its couplings 84 and 85, within pan 72. Tab fittings 102 and 104 are provided along edges of pan 72 as guides for seating digital printhead assembly 16. These features help to provide an initial coarse alignment, for printhead positioning. Component support tray 58 is secured to pan 72 which forms frame assembly 76 along with frame 70. As such, any one or a combination of component support tray 58, pan 72, frame 70, or frame assembly 76 can be considered the frame of the printing system. For example, when the first and second printer components are printheads 16, each is compliantly mounted to a component support tray 58 that is secured to frame assembly 76. It can be said then that each of the first and second printer components are compliantly mounted to any one or a combination of component support tray 58, pan 72, frame 70, or frame assembly 76.

The present invention can be used for multi-color printing, where each digital printhead assembly 16 provides a different colorant, such as a cyan, yellow, magenta, or black colorant, for example. Alternatively, the present invention can be used for single color printing. The present invention can be used in conjunction with a timing subsystem that measures the precise position of the printed dots and adjusts timing at various digital printhead assemblies 16.

The invention has been described in detail with particular reference to certain preferred embodiments thereof, but it will be understood that variations and modifications can be effected within the scope of the invention.

PARTS LIST

10. Printing system
12. Source roller
14. Dryer
15. Inspection Unit
16. Digital printhead assembly
18. Take-up roll
20. Module
22. Cross-track positioning mechanism
24. Tensioning mechanism
26. Constraint structure
30. Turnover mechanism
40. Module
44. Extended section
46. Cap
48. Tube
50. Digital printing system
52. Slack loop
58. Component support tray
60. Web media
64. Adjustment mechanism
68. Adjustment mechanism
70. Frame
72. Pan
74. Roller
76. Frame assembly
77 Compliant mount
78. Hole
80, 81. Alignment mechanism
82. Section
84, 85. Coupling
86, 87. Ball joint
88. Coupling
90. Control logic processor
92, 94. Joint
96. Ball joint
98. Spring
100. Arm
102. Recess
104. Arm
106. Recess
108. Fastener
110. Pan ledge
120 Adjustable coupling
121 Upper portion
122 Flexure
124 Lever
106 Fulcrum
128 Arm
130 Flexure
132 Clamping plate

The invention claimed is:

1. A printing system for printing on a media web moving along a media path comprising:

a frame that guides the media web along the media path in a direction of media travel;

a first printer component mounted to the frame adjacent to the media web at a location along the media path;

a second printer component compliantly mounted to the frame adjacent to the media web at a different location along the media path by a compliant mount, the second printer component being spaced apart from the media web, the compliant mount allowing the second printer component to freely move in a plane including freely moving in the direction of media travel, the compliant mount impeding motion of the second printer component perpendicular to the plane such that changes in the spacing of the second printer component and the media are inhibited; and a first alignment mechanism and a second alignment mechanism that defines the spacing between the first printer component and the second printer component, the first alignment mechanism being coupled to the first printer component with a zero backlash coupling that allows the first alignment mechanism to pivot freely, within a range of angles, relative to the first printer component and coupled to the second printer component with a zero backlash coupling that allows the first alignment mechanism to pivot freely, within a range of angles, relative to the second printer component, the second alignment mechanism being coupled to the first printer component with a zero backlash coupling that allows the second alignment mechanism to pivot freely, within a range of angles, relative to the first printer component and coupled to the second printer component with a zero backlash coupling that allows the second alignment mechanism to pivot freely, within a range of angles, relative to the second printer component.

2. The system of claim 1, wherein the first alignment mechanism and the second alignment mechanism are configured such that first alignment mechanism and the second alignment mechanism behave similarly in response to a change in temperature.

3. The system of claim 2, wherein the first alignment mechanism and the second alignment mechanism each include a material that has a low coefficient of thermal expansion.

4. The system of claim 1, wherein the first alignment mechanism and the second alignment mechanism include properties that cause the first alignment mechanism and the second alignment mechanism to behave similarly in response to a change in loading force.

5. The system of claim 4, wherein the first alignment mechanism and the second alignment mechanism include thicknesses that are substantially equal.

6. The system of claim 1, wherein the first alignment mechanism and the second alignment mechanism each include a beam positioned between the first printer component and the second printer component.

7. The system of claim 1, the first alignment mechanism including a first end and a second end, the second alignment mechanism including a first end and a second end, the first end of the first alignment mechanism being attached to the first printer component through the corresponding zero backlash coupling that allows the first alignment mechanism to pivot within a range of angles, relative to the first printer component, the second end of the first alignment mechanism being attached to the second printer component through the corresponding zero backlash coupling that allows the first alignment mechanism to pivot within a range of angles, relative to the second printer component, the first end of the second alignment mechanism being attached to the first printer component through the corresponding zero backlash coupling that allows the second alignment mechanism to pivot within a range of angles, relative to the first printer component, the second end of the second alignment mechanism being attached to the second printer component through the corresponding zero backlash coupling that allows the second alignment mechanism to pivot within a range of angles, relative to the second printer component.

8. The system of claim 1, wherein at least one of the zero backlash couplings includes a spring loaded ball joint.

9. The system of claim 1, wherein the second printer component is compliantly mounted to the frame with a plurality of flexures.

10. The system of claim 1, wherein the second printer component is compliantly mounted to the frame with a cross track position adjustment mechanism.

11. The system of claim 1, wherein the second printer component is compliantly mounted to the frame with a mechanism that permits angular adjustment of the second printer component in the plane.

12. The system of claim 1, wherein the first alignment mechanism and the second alignment mechanism are shielded from heat sources.

13. The system of claim 1, further comprising:

a third printer component compliantly mounted to the frame such that the third printer component is free to move in a plane; and a third alignment mechanism and a fourth alignment mechanism, the third alignment mechanism being coupled to the second printer component with a zero backlash coupling that allows the third alignment mechanism to pivot freely, within a range of angles, relative to the second printer component and coupled to the third printer component with a zero backlash coupling that allows the third alignment mechanism to pivot freely, within a range of angles, relative to the third printer component, the fourth alignment mechanism being coupled to the second printer component with a zero backlash coupling that allows the fourth alignment mechanism to pivot freely, within a range of angles, relative to the second printer component and coupled to the third printer component with a zero backlash coupling that allows the fourth alignment mechanism to pivot freely, within a range of angles, relative to the third printer component.

14. The system of claim 13, wherein the first alignment mechanism is not parallel to the third alignment mechanism or the fourth alignment mechanism.

15. The system of claim 1, the plane that the second printer component is free to move in being a first plane, wherein the first printer component is compliantly mounted to the frame such that the first printer component is free to move in a second plane.

16. The system of claim 15, wherein the first plane and the second plane are not parallel to each other.

17. The system of claim 1, wherein the second printer component is compliantly mounted to the frame with a flexure mechanism.

18. The system of claim 1, wherein the second printer component is positioned along the media path downstream relative to the first printer component.

19. The system of claim 1, wherein the frame includes at least one of rollers and web guides that guide the media web along the media path.

20. The system of claim 1, the first printer component mounted to the frame by a mount, the second printer component being compliantly mounted to the frame by the compliant mount, wherein the mount and the compliant mount are distinct from the first alignment mechanism and the second alignment mechanism such that the spacing between the first printer component and the second printer component is defined by the first alignment mechanism and the second alignment mechanism.

* * * * *